US007597718B2

(12) United States Patent
Yoshikawa et al.

(10) Patent No.: US 7,597,718 B2
(45) Date of Patent: Oct. 6, 2009

(54) METHOD AND WASHING MACHINE FOR IMPARTING ANTISTATICITY TO FABRIC STRUCTURE AND FABRIC STRUCTURE IMPARTED WITH ANTISTATICITY

(75) Inventors: Hirofumi Yoshikawa, Osaka (JP); Rie Hiramoto, Yamatokooriyama (JP); Kyoko Iimori, Yao (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 0 days.

(21) Appl. No.: 11/664,289

(22) PCT Filed: Jun. 27, 2005

(86) PCT No.: PCT/JP2005/011705

§ 371 (c)(1),
(2), (4) Date: Mar. 30, 2007

(87) PCT Pub. No.: WO2006/043355

PCT Pub. Date: Apr. 27, 2006

(65) Prior Publication Data

US 2007/0251022 A1 Nov. 1, 2007

(30) Foreign Application Priority Data

Oct. 19, 2004 (JP) ..... 2004-304809

(51) Int. Cl.
*D06M 11/83* (2006.01)

(52) U.S. Cl. ..... 8/115.6; 8/115.51; 442/110; 252/8.61; 252/8.81; 252/8.91

(58) Field of Classification Search ..... 8/115.51, 8/115.6; 442/110; 252/8.61, 8.81, 8.91
See application file for complete search history.

(56) References Cited

U.S. PATENT DOCUMENTS

| | | | | | |
|---|---|---|---|---|---|
| 4,681,820 | A * | 7/1987 | Tomibe et al. | ..... | 428/698 |
| 5,674,373 | A * | 10/1997 | Negrerie et al. | ..... | 205/160 |
| 6,004,889 | A * | 12/1999 | Ichikawa | ..... | 442/110 |
| 7,341,674 | B1 * | 3/2008 | Trinh et al. | ..... | 252/8.61 |
| 2004/0106341 | A1 | 6/2004 | Vogt et al. | | |
| 2004/0261194 | A1 * | 12/2004 | Price et al. | ..... | 8/137 |

FOREIGN PATENT DOCUMENTS

| | | | |
|---|---|---|---|
| EP | 1652990 | A1 | 5/2006 |
| JP | 4-119168 | A | 4/1992 |
| JP | 4-136268 | A | 5/1992 |
| JP | 4-153367 | A | 5/1992 |
| JP | 6-294070 | A | 10/1994 |
| JP | 10-33888 | A | 2/1998 |
| JP | 10-140439 | A | 5/1998 |
| JP | 2000-034640 | A | 2/2000 |
| JP | 2001-049541 | A | 2/2001 |
| JP | 2001-276484 | * | 10/2001 |
| JP | 2001-276484 | A | 10/2001 |
| JP | 2004-057423 | A | 2/2004 |
| KR | 2001-2179 | | 1/2001 |
| KR | 10-0368426 | B1 | 11/2001 |
| KR | 10-2004-0045192 | A | 6/2004 |

OTHER PUBLICATIONS

"Resources of clothes and clothing materials" Publication Date: Dec. 10, 1989, Japan Society of Home Economics, Published by Asakura Shoten, Co., Ltd. pp. 163-164.

* cited by examiner

*Primary Examiner*—Lorna M Douyon
*Assistant Examiner*—Amina Khan
(74) *Attorney, Agent, or Firm*—Birch, Stewart, Kolasch & Birch, LLP

(57) ABSTRACT

Provided are a method capable of imparting antistaticity to a fabric structure in a simple manner without causing any color change in the fabric structure, a fabric structure imparted with antistaticity by the method, and a washing machine that imparts antistaticity to a fabric structure according to the method. The method for imparting antistaticity to a fabric structure allows a metal or metal compound to adhere on a surface of the fabric structure by drying the fabric structure in a state where a liquid containing the metal or the metal compound exists on the surface of the fabric structure.

8 Claims, 4 Drawing Sheets

METHOD AND WASHING MACHINE FOR IMPARTING ANTISTATICITY TO FABRIC STRUCTURE AND FABRIC STRUCTURE IMPARTED WITH ANTISTATICITY

TECHNICAL FIELD

The present invention relates to a method for imparting antistaticity to a fabric structure. In particular, the present invention relates to a method for providing a fabric structure having an excellent antistatic performance.

BACKGROUND ART

During the winter season, people sometimes feel a static shock just on touching a door knob or an automobile body due to the dried air. Static electricity may also generate due to the friction between lining of a skirt which is a fabric structure comprising chemical fibers (polyester fabric structure) and stockings (nylon fabric structure) at every step of the wearer. This generation of static electricity causes static cling between the skirt and legs, which may make the wearer feel difficulty of walking. Another problem arises that the atmospheric dust that is attracted by the generating static electricity will gradually make the clothes dirty.

In order to eliminate these phenomena, conventionally, antistatic sprays and the like have been commercially available. However, it takes great labor to spray on the entire clothing that one currently wears, and further it is not only costly but also troublesome to repeat spraying whenever one changes into other clothing.

Under such a circumstance, a fabric softener based on a positive-ion surfactant is ordinarily added during washing to prevent static electricity from generating on clothes. Fabric softener aim at preventing static electricity from generating by attracting water in the atmosphere to fibers, thereby increasing the electric conductivity on the surface of the clothes. Therefore, there is still a problem that little effect is obtained in dry environment such as in the winter season where generation of static electricity is significant.

As measures to clothes per se, an attempt is made to constitute a fabric structure by combining extra-fine metal threads obtained by finely extending silver or copper, plated threads obtained by plating silver or copper on the surface of threads, conductive fibers, carbon fibers or the like so as to prevent generation of static electricity.

For example, Japanese Unexamined Patent Publication No. 10-140439 (Patent Document 1) proposes cloth for kimono (Japanese traditional dress) intended to make a "Kimono" that can be worn without bothered by static electricity and has excellent appearance and texture, wherein silver plated nylon serving as conductive fibers is continuously interwoven along the length of the edge of the cloth.

In addition, Japanese Unexamined Patent Publication No. 2000-34640 (Patent Document 2) proposes a silver fiber-interwoven structure wherein threads of silver fibers are interwoven at an optional proportion into a cloth woven in an optional weave so as to control the charge quantity of static electricity during use.

Further, Japanese Unexamined Patent Publication No. 2001-49541 (Patent Document 3) proposes a laminate thread capable of maintaining an antistatic function even after repeated washings, which is fabricated by the steps of vapor-depositing antibacterial metal such as silver, copper, zinc and the like on a synthetic resin film by vacuum deposition or ion deposition to form a deposition coating; bonding synthetic resin films having the deposition coating together so that the deposition coatings are inside; and thinly cutting the resultant bonded laminate having a sandwich structure in a vertical direction.

In "Resources of clothes and clothing materials", Chapter 4 "Imparting of additional value on clothing material", Item d. "Principal of imparting antistaticity", pp. 163-164, Dec. 10, 1989, The Japan Society of Home Economics ed., Asakura Shoten, Co., Ltd. (Non-patent Document 1), there can be found descriptions about mixing hydroscopic fibers such as wool, cotton or rayon, or mixing metal fibers such as copper, aluminum or stainless or conductive fibers such as carbon so as to prevent static electricity from generating as much as possible, or to rapidly make the static electricity, if occurs, escape outside.

Patent Document 1: Japanese Unexamined Patent Publication No. 10-140439

Patent Document 2: Japanese Unexamined Patent Publication No. 2000-34640

Patent Document 3: Japanese Unexamined Patent Publication No. 2001-49541

Non-patent Document 1: "Resources of clothes and clothing materials", pp. 163-164, Dec. 10, 1989, The Japan Society of Home Economics ed., Asakura Shoten, Co., Ltd.

DISCLOSURE OF THE INVENTION

Problems to be Solved by the Invention

According to the methods proposed in Japanese Unexamined Patent Publication Nos. 10-140439, 2000-34640 and 2001-49541, it is possible to suppress the charge quantity of static electricity during use because silver contained in the silver-plated nylon, silver fiber or deposition coating has the highest conductivity among metals. However, laminate threads containing metal plated fiber, metal threads or metal deposition coating suffer from the problem that the surface is oxidized and blackened due to aged deterioration or by a bleaching agent, resulting in deterioration in appearance of the fabric structure.

As described in "Resources of clothes and clothing materials", mixing of conductive fiber such as carbon will limit the kinds of products such as clothes obtainable by using the fabric structure due to the black color of the carbon fiber.

Products such as clothes formed of a fabric structure using laminate threads containing metal plated fibers, metal fibers or metal deposition coating as proposed in the aforementioned publications are sold at relatively high prices compared to conventional ones. Therefore it is very difficult to produce every clothes that are ordinarily worn from special fibers or threads as described above to impart antistaticity.

Therefore, it is an object of the present invention to provide a method capable of imparting antistaticity to a fabric structure in a simple manner without causing any color change, a fabric structure imparted with antistaticity by the method, and a washing machine for imparting antistaticity to the fabric structure by the method.

Means for Solving the Problems

A method for imparting antistaticity to a fabric structure according to the present invention includes drying a fabric structure in a state where a liquid containing metal or a metal compound exists on a surface of the fabric structure, thereby allowing the metal or the metal compound to adhere on the surface of the fabric structure.

The method of the present invention is simpler than conventional methods because antistaticity can be imparted to the fabric structure only by drying after placing the aforementioned liquid on the surface of the fabric structure. Furthermore, in the method of the present invention, it is possible to impart the antistatic function to the surface of the fabric structure by allowing a relatively smaller amount of metal or metal compound compared to that in conventional methods, to adhere on the surface of the fabric structure. Therefore, it is possible to impart antistaticity to the surface of the fabric structure without causing any color change in the fabric structure.

In the method for imparting antistaticity to a fabric structure according to the present invention, preferably, the state where the liquid exists on the surface of the fabric structure is achieved by spraying the liquid on the surface of the fabric structure. In this case, since the liquid can be brought into existence on the surface of the fabric structure without entering inside the fabric structure, it is possible to impart the antistatic function to the surface of the fabric structure by making a less amount of metal or metal compound adhere on the surface of the fabric structure.

In the method for imparting antistaticity to a fabric structure according to the present invention, preferably, the liquid is water containing metal ions. In this case, it is possible to make the liquid containing metal or a metal compound exist on the surface of the fabric structure only by bringing the metal ion water into contact with the surface of the fabric structure.

In the method for imparting antistaticity to a fabric structure according to the present invention, preferably, the metal is silver. In this case, it is possible to impart antistaticity to the surface of the fabric structure safely only by making a less amount of metal or metal compound adhere, because silver, in particular, has high conductivity and gives little dermal irritancy on human body.

Furthermore, in the method for imparting antistaticity to a fabric structure according to the present invention, preferably, the liquid containing metal or a metal compound is a liquid in which metal ions elute out by electrolysis of metal electrodes in the liquid. In this case, it is possible to readily produce the liquid containing metal or a metal compound.

In the method for imparting antistaticity to a fabric structure according to the present invention, preferably, the metal or the metal compound is made to adhere in an amount in a range between 0.5 mg or more and 50 mg or less, with respect to 1 kg of the fabric structure. In this case, it is possible to impart antistatic function that is enough to prevent static electricity from generating on the surface of the fabric structure, and to decrease the possibility of causing a color change on the fabric structure due to adhesion of the metal or the metal compound.

In the method for imparting antistaticity to a fabric structure according to the present invention, preferably, the fabric structure is a structure containing chemical fiber. In this case, since the chemical fibers have relatively low coefficient of water absorption and are likely to generate static electricity, it is possible to impart antistatic function to the surface of the fabric structure more efficiently.

In the method for imparting antistaticity to a fabric structure according to the present invention, preferably, the fabric structure is clothes, and the liquid containing metal or a metal compound is applied on surfaces of the clothes after a washing step of the clothes. In this case, it is possible to impart antistaticity to the surface of clothes during or after washing which is a part of routine work without conducting any special operation or treatment on ordinarily worn clothes.

The fabric structure according to the present invention is a fabric structure that is imparted with antistaticity according to any one of the aforementioned methods.

The washing machine according to the present invention is a washing machine which imparts antistaticity to a fabric structure by any one of the aforementioned methods.

EFFECT OF THE INVENTION

As described above, according to the present invention, it is possible to impart an antistatic function to a fabric structure by allowing a smaller amount of metal or metal compound to adhere on the surface of the fabric structure in a simpler manner than conventional methods. Therefore, it is possible to impart antistaticity to the fabric structure without causing any color change in the fabric structure.

EXPLANATION OF SYMBOLS

Figure 1:
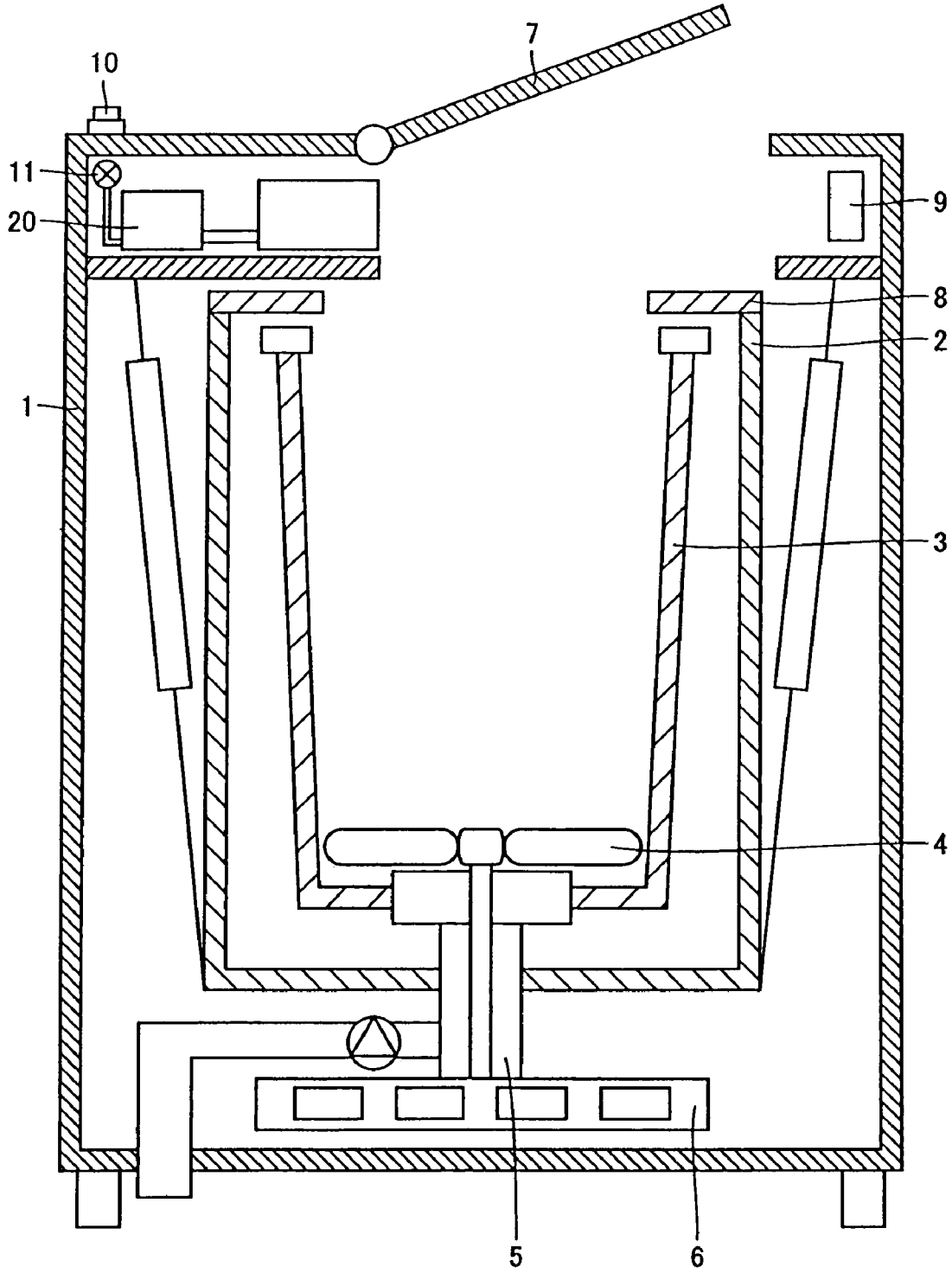
FIG. 1 is a view schematically showing a configuration of a washing machine capable of washing while supplying silver ion water as a result of application of the present method.

20: electrolysis part, 21: vessel, 24, 25: electrodes

Best Mode for Carrying Out the Invention

In one embodiment of the present invention, a method for imparting antistaticity to a fabric structure includes drying a fabric structure in a state where water containing silver ions exists on the surface of the fabric structure, thereby allowing silver or a silver compound to adhere on the surface of the fabric structure. Herein, with respect to the terms "state where water containing silver ions exists on the surface of the fabric structure", it is assumed a state where silver ions in water electrically adhere to the surface of the fabric structure which is negatively charged, or a state where water containing silver ions exists and adheres on the surface of the fabric structure via surface tension.

Silver is used as metal in the liquid containing metal or a metal compound because it has the highest conductivity among metals and requires a very small amount to impart antistaticity, and it little influences on allergy to metal. Examples of other metal that can be used include platinum, palladium, gold, copper, zinc, iron, nickel, chromium and the like. As to metal compounds, any kinds of compound can impart antistaticity to a fabric structure insofar as they have conductivity.

By adopting ions as an existing state of metal in liquid, it is possible to readily produce a liquid containing metal or a metal compound.

In one embodiment of the present invention, water or the like which serves as a liquid containing metal such as silver ions or a metal compound is brought into existence on the surface of the fabric structure, and then dried, whereby conductive metal particles and the like adhere on the surface of the fibers, the unbalanced charges are neutralized and the positive polarity and negative polarity are balanced out, and charges no longer generate in the fabric structure. As a result, the surface potential of the fabric structure may become relatively small.

The action of the metal particles and the like adhered on the surface to conduct electricity may facilitate leaking of accumulated charges in the fibers. This would make the leak quantity of charges relatively large.

Generally, charge quantity is determined by subtracting leak quantity from generation quantity of charges, and hence by increasing the leak quantity and by reducing the generation quantity of charges, the charge quantity is reduced. In the method of the present invention, by allowing the conductive metal particles and the like to adhere on the surface of fibers by using a liquid as a medium, generation quantity of charges in the fabric structure is reduced, and the charges accumulating in the fibers become more likely to leak. Accordingly, the charge quantity is reduced. As a result, it is possible to impart the antistatic function, i.e., antistaticity to the fabric structure.

The method of the present invention is applicable to fabric structures formed of any fibers including cloths, woven cloths and nonwoven cloths. Fibers are generally classified into chemical fibers and natural fibers. Examples of the chemical fibers include polyester, nylon, acryl, polyethylene, polyurethane, acetate, rayon, cupra and the like. Examples of the natural fibers include cotton, hemp, wool (sheep wool) and the like.

Next, as one embodiment of the method for imparting antistaticity to a fabric structure according to the present invention, description will be given of a method in which the fabric structure is clothes, and as a liquid containing metal or a metal compound, water containing silver ions is allowed to remain on the surface of the clothes after a washing step.

FIG. 1 is a view schematically showing a configuration of a washing machine capable of washing while supplying silver ion water as a result of application of the method of the present invention.

As shown in FIG. 1, inside an outer tank 1 constituting a main body of a washing machine, a water tank 2 is provided such that it is hung by four supporting mechanisms located around the water tank 2. Inside the water tank 2 is provided a washing and dewatering tank 3, and below the bottom of the water tank 2 within the outer tank 1 is provided a mechanism part 5. The mechanism part 5 has a motor 6 and transmits motion of the motor 6 to the washing and dewatering tank 3.

Inside the water tank 2, the washing and dewatering tank 3 is rotatably disposed. The washing and dewatering tank 3 has an inner bottom provided with a stirring part embodied by a pulsator 4, and the washing and dewatering tank 3 and a clutching mechanism may rotate in an interlocked manner or independently. The washing and dewatering tank 3 is formed as a so-called non-hole tank having no small pores on its wall surface. The washing and dewatering tank 3 has a tapered side wall face. Water discharge during dewatering is accomplished by water to pass through small pores located in upper part of the washing and dewatering tank 3 into the water tank 2.

On the periphery of an upper end opening of the outer tank 1, an upper face plate 7 having an operational panel (not shown) is attached. The operational panel forms the exterior of upper part of the washing machine. In the center of the upper plate 7, a laundry input opening 8 is formed. In the outer tank 1 are provided a water level sensor (not shown) for detecting the water amount in the washing and dewatering tank 3, and a controller 9 for detecting input load of laundry.

To start an operation, laundry is put into the washing and dewatering tank 3 and the motor 6 is caused to drive. Then, rotation of the motor 6 is transmitted through the mechanism part 5 to the washing and dewatering tank 3, and the laundry inside the washing and dewatering tank 3 is stirred. In early stirring, a load within the washing and dewatering tank 3 is determined in accordance with a program preset in the controller 9, and a water level is determined based on the load. Then, water supply through a water supply port 10 connected to the washing machine starts and thus a washing is started. The motor 6 is able to produce a dewatering operation by continuously rotating the washing and dewatering tank 3 at high speed via the mechanism part 5.

The washing machine that is configured and operates as described above is also provided, in its water supply path, with an electrolysis part 20 having an electrode formed of silver plate as a metal plate in order to realize the method of the present invention.

Figure 2A:
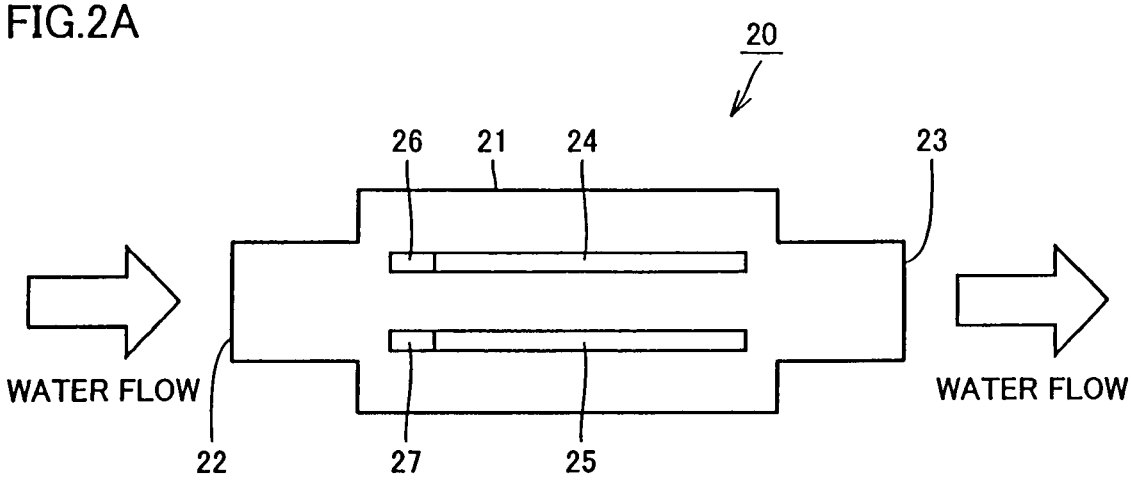
FIGS. 2A and 2B are a plan view and a side sectional view each illustrating an electrolysis part provided in the washing machine shown in FIG. 1.
Figure 2B:
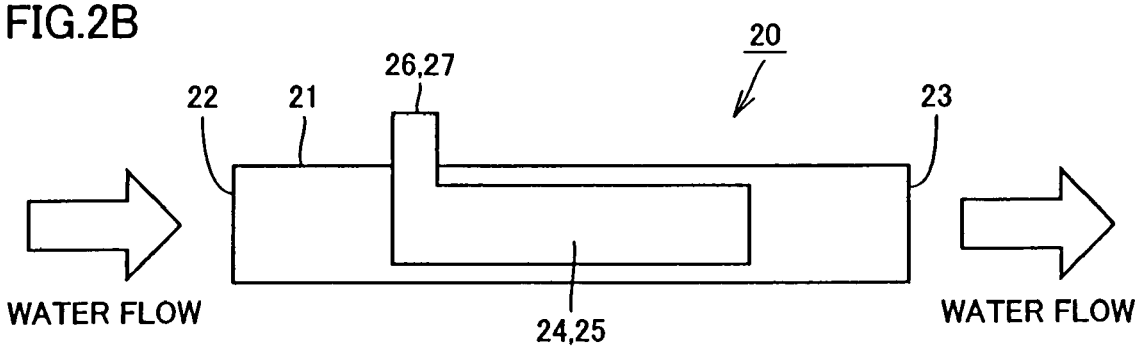

FIGS. 2A and 2B are a plan view and a side sectional view each showing the electrolysis part 20 provided in the washing machine 1. The electrolysis part 20 includes a vessel 21 made of an insulating material such as synthetic resin or rubber, a liquid inlet 22 provided at one end of the vessel 21, a liquid outlet 23 provided at the other end of the vessel 21, two sheet-like electrodes 24 and 25 which are arranged almost in parallel with each other in the vessel 21, and terminals 26 and 27 respectively connecting the electrodes 24 and 25. The electrodes 24 and 25 are formed of silver. The electrodes and terminals may be integrally formed. When the electrode and the terminal are not integrally formed, it is preferable to coat a junction between the electrode and the terminal, and the terminal with a resin so that they will not come into contact with water for preventing electric contact. The metal forming electrodes may be copper or mixture of silver and copper in place of silver.

With the configuration of the electrolysis part 20 as described above, when water is supplied into the vessel 21 via the inlet 22 and voltage is applied across the terminal 26 and the terminal 27 of the electrolysis part 20 during a rinsing step of washing, for example, silver ions ($Ag^+$) will elute from a positive electrode into the water in the vessel 21. The water containing silver ions flown out through the outlet 23 is supplied inside the washing and dewatering tank 3. By conducting a rinsing step within the washing and dewatering tank 3 using water containing silver ions, it is possible to impart antistaticity to clothes and the like which is a fabric structure as a laundry.

FIG. 2B is a sectional view cut along the vertical plane of the electrolysis part 20 in FIG. 2A. In this example, the terminals 26 and 27 are provided on end edges on the upper faces of the electrodes 24, 25. Preferably, the bottom face of the vessel 21 is sloped so that the downstream side is lower in order to prevent water from accumulating in the vessel 21 after water supply to the washing and dewatering tank 3.

As a water supply electromagnetic valve 11 opens, tap water is fed into the vessel 21 of the electrolysis part 20 in the water supply path, and in the electrolysis part 20, electrolysis starts around the electrodes 24, 25 upon application of voltage. Water supply is achieved by water pressure of running water. The time for electrolysis is controlled depending on the load of the laundry. Water having passed through the electrolysis part 20 contains silver ions, and the water containing silver ions is fed into the washing and dewatering tank 3.

Now, description will be given of an operation of the washing machine. After putting the laundry into the washing and dewatering tank 3, turning on the power switch, and selecting a process level so as to adjust the adhesion amount of silver, the user presses a start button. The washing machine detects the load of the clothes by rotations of the pulsator 4 and controls so that water is supplied into the washing and dewatering tank 3 up to an indication value of a water level sensor, the indication value being appropriate for the load of the clothes. After detecting the load of the clothes, the water supply electromagnetic value 11 is opened under the control of an integrated microcomputer. Tap water is fed from a water tap into the washing and dewatering tank 3 through the water supply electromagnetic valve 11. Then, the pulsator 4 provided in the bottom of the washing and dewatering tank 3 is forwardly and reversely rotated to start washing.

After completion of the washing step, water added with metal ions by electrolysis is fed to the laundry having subjected to intermediate dewatering. The amount of silver ion is appropriate to the load and the process level determined at the beginning of the washing. For example, as an amount of silver ion necessary to reach a silver ion concentration in a defined amount of water of 300 ppb has been added, the voltage application to the electrodes 24, 25 is stopped and water supply is continued until a predetermined water amount is reached. As the predetermined water amount has been reached, the laundry distributed in a V-shape begins separating from the washing and dewatering tank 3 by rotation of the pulsator 4 provided in the bottom of the washing and dewatering tank 3. After stirring for a certain time by rotation of the pulsator 4, the operation of the pulsator 4 is stopped. Thereafter, the laundry is kept immersed for a certain time for allowing the silver ions to act thereon. At this time, the operation of the washing machine may be completely stopped, however, the washing and dewatering tank 3 may be rotated slowly for making the user notice that it is still during washing.

After conducting a rinsing step for a predetermined time, for example, for 10 minutes, as described above, water is drained and the operation proceeds to a final dewatering step. The aforementioned process level is set at a strong level, and silver ion water is added before starting a dewatering step at low rotational speed, whereby an adhesion amount of silver existing on the surface of the clothes is made relatively large. For example, after applying silver ion water having a silver ion concentration in water of 600 ppb to clothes for 40 seconds twice, silver is caused to adhere on the clothes by low speed rotation at 100 rpm for 5 minutes.

The clothes thus washed is dried, and the clothes bears 0.5 mg/kg or more silver or silver compound per 1 kg of clothes. Accordingly, the antistatic function is imparted by adhesion of silver or silver compound, especially on the surface of the clothes, so that the static electricity is difficult to generate.

The fabric structure imparted with antistaticity according to the method of the present invention not only reduces static uncomfortability to the wearer when the fabric structure is applied to clothes, but also prevents electronically or electrically mediated products such as electronic devices with which the fabric structure may come into contact from statically breaking due to generation of static electricity when the present invention is applied to a variety of fabric structures.

Examples

Figure 3:
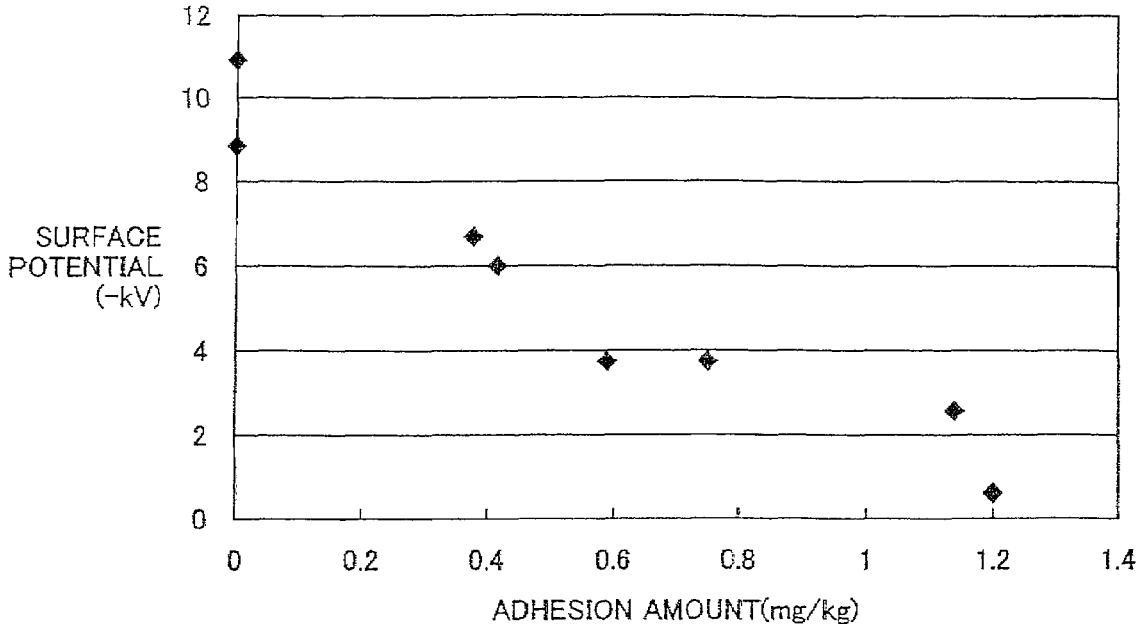
FIG. 3 is a view showing the relationship between an adhesion amount of silver or a silver compound to clothes and a surface potential of the clothes, as one example of a method according to the present invention.

FIG. 3 is a graph showing the relationship between an adhesion amount of silver or a silver compound to clothes and a surface potential of the clothes as one example of the method of the present invention.

After spraying silver ion water having a silver ion concentration of 600 ppb on the surface of clothes, a surface potential on the dried clothes was measured.

As the clothes, a standard adjacent cloth for a color fastness test defined by JIS L0803 was used. Concretely, the used cloth was a standard cloth (polyester cloth) produced by plain-weaving polyester filament yarns, in which both warp yarns and weft yarns have a thickness of 8.3 TEX, the warp yarns are woven in a density of 210 yarns per 5 cm, the weft yarns are woven in a density of 191 yarns per 5 cm, and the cloth weight is 70 g/m$^2$.

The adhesion amount of the silver or silver or the silver compound was varied by repetitions of spraying the clothes with the silver ion water and drying of the clothes.

The adhesion amount was calculated from a measured spraying amount of silver ion water and a weight of dried cloth in accordance with the following calculation formula.

Adhesion amount(mg/kg)=(sprayed amount of silver ion water(litter)×0.6 mg/litter)/weight of dried cloth(kg)

Measurement of surface potential of clothes was conducted in the following manner. First, a processed polyester cloth as described was placed on a rubber support, the surface of the polyester cloth was rubbed with a standard adjacent cloth (wool cloth) for a color fastness test defined by JIS L0803 five times, and then surface potential at the time of pulling up the polyester cloth from the rubber support was measured by a portable surface potentiometer. The temperature and the humidity at the time of measurement were 30° C. and 60%, respectively.

As can be seen from FIG. 3, the test result shows that the adhesion amount of silver and silver compound on the surface of the polyester cloth can be increased and the surface potential of the clothes can be lowered by spraying the surface of the cloth with the silver ion water prior to drying. In general, when the absolute value of surface potential of clothes becomes 5 kV or less, the clothes becomes difficult to cling the wearer, and hence it can be understood that about 0.5 mg/kg (per 1 kg of polyester cloth) should be adhered from the result of FIG. 3. Sufficient antistatic effect would be achieved when the adhesion amount is 5 mg/kg or more, however, the adhesion amount is desirably controlled so as not to exceed about 50 mg/kg because the color of fibers may change due to adhesion of too many silver particles and the like.

With regard to the aforementioned polyester cloth sprayed with silver ion water having a silver concentration of 600 ppb and with regard to the aforementioned polyester cloth sprayed with tap water, the surface potential after rubbing with a wool cloth in the same manner as described above was measured. In contrast to the surface potential of −15.3 kV determined for the polyester cloth sprayed with tap water, the surface potential of −2.5 kV determined for the polyester cloth sprayed with the silver ion water was significantly small in respect of absolute value of surface potential, which confirms an antistatic effect which is an effect contributing to impartment of antistaticity to the fabric structure according to the method of the present invention.

Furthermore, according to a half-life measuring method defined by JIS L1094:1997, the aforementioned polyester cloth sprayed with silver ion water having a silver concentration of 600 ppb and the aforementioned polyester cloth sprayed with tap water were examined for half-life. In contrast to the half-life of 120 seconds or more determined for the polyester cloth sprayed with tap water, the half-life of 48 seconds determined for the polyester cloth sprayed with the silver ion water was significantly small in respect of half-life of charge quantity, which confirms a great charge leaking effect contributing to impartment of antistaticity to the fabric structure according to the method of the present invention.

After drying the aforementioned polyester cloth sprayed with silver ion water and the aforementioned polyester cloth sprayed with tap water, pollen (cedar) was caused to uniformly adhere on these cloths. Then, these cloths were mounted to a pollen release test machine and a predetermined shake (like dusting off by hand) was given to these cloths to release the pollen from the cloths. The amount (proportion) of the dropping amount of the pollen adhered on the clothes, namely, reduction percentage of pollen was evaluated by counting the number of pollen before and after the release. As a result, in contrast to the reduction percentage of about 30% determined for the polyester cloth sprayed with tap water, the reduction percentage of about 60% determined for the polyester cloth sprayed with the silver ion water was significantly large, which confirms a pollen eliminating effect contributing to impartment of antistaticity to the fabric structure according to the method of the present invention. As a result, even when pollen adheres outdoors on the surface of the clothes, the pollen may be readily removed from the surface of clothes if the clothes have antistaticity imparted by the method of the present invention. This may be accompanied with an additional effect that pollen brought indoors is minimized.

As shown in Japanese Unexamined Patent Publication No. 2001-49541, in comparison with a laminate thread containing a deposition film given by ion deposition of silver ions, it is possible to give a surface potential having a smaller absolute value to the fabric structure and to obtain a shorter half-life of charge quantity as the effects contributing to impartment of antistaticity to a fabric structure according to the method of the present invention. As a result, a great leaking effect of charges is given to the fabric structure.

From the results of the aforementioned examples, concrete advantages of the method for imparting antistaticity to a fabric structure which is one embodiment of the present invention will be summarized as follows.

(1) Since the method of the present invention is conducted by immersing a fabric structure in a liquid containing metal ions such as silver ion water or the like, or by spraying the aforementioned liquid on the fabric structure, it is possible to allow a conductor to uniformly adhere on the surface of the fabric structure, and hence to minimize the use amount of conductor required for imparting certain antistaticity, i.e., the adhesion amount of metal or metal compound that is required to impart certain antistaticity. In contrast to this, according to conventional method proposed in the aforementioned publication, the conductor can be adhered on a cross section or a part of surface of a thread but not the entire surface of the thread, so that the use amount of the conductor required to impart certain antistaticity is large.

(2) According to the method of the present invention, only a liquid containing metal ions should be prepared for imparting antistaticity to the fabric structure, and this liquid can be obtained in a simple manner only by electrolyzing metal plates in water. To the contrary, in the conventional method proposed in the aforementioned publication, a process in high vacuum is required for vapor deposition of metal on the surface of a synthetic resin film, so that it is difficult to conduct the process with a home-use machine or the like.

(3) According to the method of the present invention, it is possible to conduct a process of imparting antistaticity on various states of fabric structure, such as, in woven fabric state and in sewn clothes. To the contrary, in the conventional method proposed in the aforementioned publication, it is necessary to conduct a process for imparting antistaticity prior to forming into a thread, so that it is impossible to conduct a process of imparting antistaticity on a fabric structure which is in a fabric state.

Although polyester fibers which are chemical fibers were used as the fabric structure in the aforementioned experiments, similar effects may be achieved by using fabric structures of chemical fibers other polyester fibers, of natural fibers, or of combination of chemical fiber and natural fiber.

Figure 4:
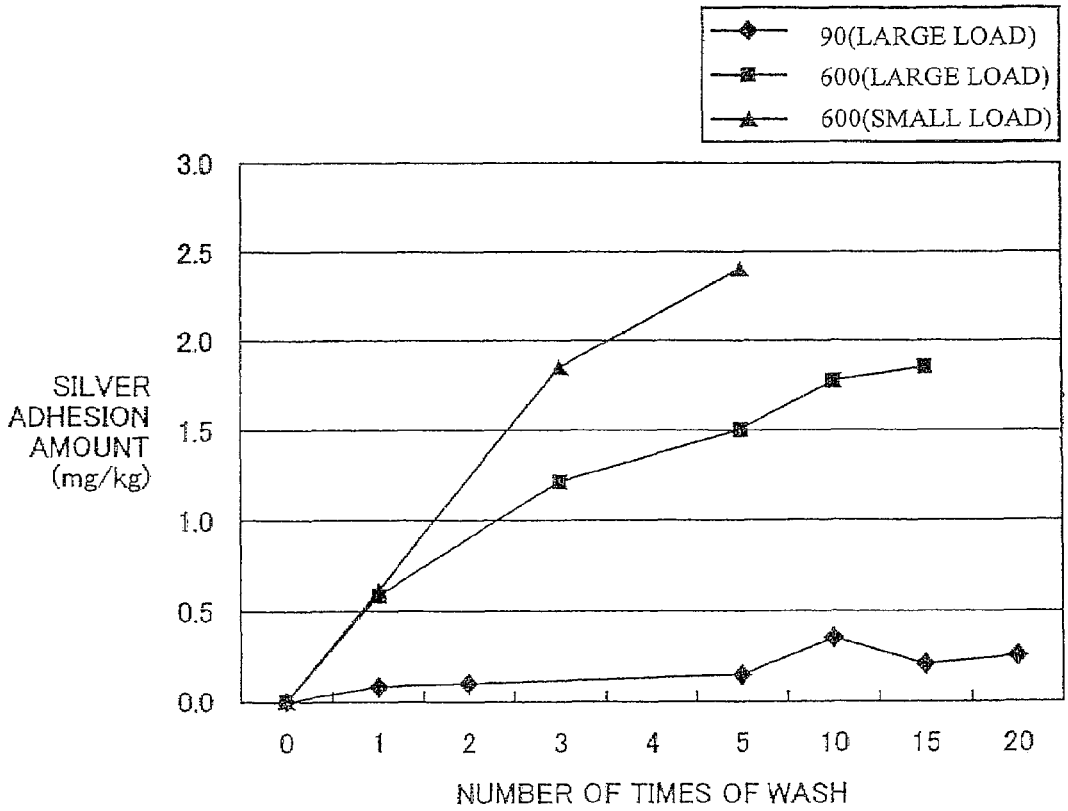
FIG. 4 is a view showing the relationship between the number of wash and an adhesion amount of silver when the method of the present invention is carried out using the washing machine shown in FIG. 1.

FIG. 4 is a graph showing the relationship between the number of times of wash and a silver adhesion amount when the method of the present invention is carried out using the washing machine described in the aforementioned embodiment.

As the clothes to be washed, a polyester cloth which is a standard adjacent cloth for color fastness test defined by JIS L0803 and a cotton cloth were used.

In FIG. 4, the denotation "large load" indicates the case where a polyester cloth and a cotton cloth were washed together (load weight: about 2 kg) and the denotation "small load" indicates the case where only a polyester cloth was washed (total load weight: about 200 g). The "silver adhesion amount" that changes with the number of times of wash indicates a silver adhesion amount on the polyester cloth that is dried following a rinsing step and a dewatering step conducted in a state where silver ion water is supplied using the washing machine described in the aforementioned embodiment. The condition "90" indicates a silver adhesion amount on the polyester cloth that is dried after undergoing the steps of: supplying with 28 litters of silver ion water having a silver concentration of 90 ppb per about 2 kg of total load weight, stirring for 10 minutes, and dewatering. The condition "600" indicates a silver adhesion amount of a polyester cloth that is dried after undergoing the steps of: supplying with 28 litters of silver ion water having a silver concentration of 300 ppb per about 2 kg of total load weight; stirring for 10 minutes; dewatering; again supplying with silver ion water having a silver concentration of 600 ppb for 1 minute (about 3 litters) while rotating the washing and dewatering tank 3 at 100 rpm; continuing rotation at 100 rpm for 5 minutes so as to allow the silver ion water to spread over the entire load; and dewatering.

The result shown in FIG. 4 demonstrates that the silver adhesion amount increases as a result of repeated washings while applying the method of the present invention. Also, immersion in silver ion water having a relatively high concentration and stirring in an immersed condition increase the silver adhesion amount per one wash. Accordingly, it is possible to increase the silver adhesion amount on the surface of the cloth.

In the results of experiments shown in FIG. 4, the silver adhesion amount was as high about 2.5 mg/kg at maximum for five washes because a cloth of 100% chemical fiber, e.g., 100% polyester was used. However, when a blended fabric structure such as clothes of cotton 65% and polyester 35% was subjected to a rinsing step and a dewatering step in the condition "600" and dried, about 9.0 mg/kg for five washes and about 10.7 mg/kg for ten washes were achieved. Therefore, by varying the silver ion concentration, load weight of washing, condition of rinsing step, condition of dewatering condition, the number of times of wash and the like depending on the kind of fibers that constitute the fabric structure to be washed, it is possible to change the silver adhesion amount. Accordingly, it is possible to change the silver adhesion amount on the surface of the cloth, and as a result, it is possible to vary the antistatic performance imparted to the particular clothes.

Even when the silver adhesion amounts with respect to cloth are almost the same, by varying the manner of applying the silver ion water on the cloth, it is possible to vary the antistatic performance imparted to the particular clothes.

Table 1 shows a result of examination for knowing whether charge potential (kV) of the surface of cloth changes when the manner and the time of applying silver ion water on the cloth are changed. As a type of cloth, a polyester cloth was used. As a condition in applying silver ion water on the cloth, the following four conditions were established: "applying with shower for 3 seconds", "applying with shower four 20 seconds", "spraying using an atomizer (mist)" and "spraying using an atomizer (liquid)". As to the former two conditions, test clothes was directly put close to the position where silver ion water was supplied through a water supply port in the form of shower, to make the surface of the clothes wet. The silver adhesion amount (mg/kg) indicates a calculated value based on the aforementioned equation. Charge potential on surface of the polyester cloth was determined by measuring a charge potential after three rubbings with a wool cloth. The condition "atomizer liquid)" means the condition where a nozzle of an atomizer is opened, and silver ion water is sprayed on the surface of the polyester cloth in a manner like a water gun.

TABLE 1

| Condition | No. | Silver adhesion amount (mg/kg) (calculated value) | Charge potential (kV) |
|---|---|---|---|
| Shower for 3 sec. | 1 | 0.32 | −1.2 |
| | 2 | 0.26 | −1.9 |
| Shower for 20 sec. | 1 | 0.32 | −8.2 |
| | 2 | 0.5 | −8.8 |
| Atomizer (mist) | 1 | 1.59 | −3.7 |
| Atomizer (liquid) | 2 | 1.66 | −14.2 |

From the results shown in Table 1, it is demonstrated that an absolute value of charge potential of the surface of the polyester cloth decreases and the antistatic performance increases in the condition of applying silver ion water to the cloth with shower for a short time, compared to the condition of applying for a long time. Also, an absolute value of charge potential of the surface of the polyester cloth decreases and the antistatic performance increases when silver ion water is applied in mist form, compared to the case where silver ion water is applied in liquid form. In conclusion, the antistatic performance can be increased more effectively by allowing a relatively large amount of silver or silver compound to adhere on the surface of the cloth by drying in a state where a relatively large amount of silver ion water exists on the surface of the cloth, in other words, in a state where a relatively large amount of silver ion water remains on the surface of the cloth while preventing the silver ion water from entering inside the cloth, even if the silver adhesion amount is almost the same.

In order to verify the aforementioned conclusion, setting the amount of silver adhered on polyester cloths constant, Sample A having silver or silver compound adhered thereon by drying after entry of silver ion water inside the cloth, and Sample B having silver or silver compound adhered thereon by drying while silver ion water exists on the surface of the cloth were examined for the adhesion states of silver or silver compound.

Sample A was obtained by conducting the following steps: washing a preliminarily washed polyester cloth with detergent; stirring in silver ion water having a concentration of 300 ppb; dewatering four 6 minutes by rotation of 100 rpm while applying silver ion water having a concentration of 600 ppb; and finally dewatering by a centrifugal force. Sample B was obtained by seven repetitions of spraying silver ion water having a concentration of 600 ppb on the preliminarily washed polyester cloth with an atomizer and drying with a dryer. In Samples A and B thus obtained, the adhesion amount of silver or a silver compound was 1.8 mg/kg. The charge potential (kV) of the surface of the Sample A was −7.6 to −10.6 kV, and the charge potential (kV) of the surface of the Sample B was −2 kV. Charge potential was measured using a handy static meter (FMS-002 manufactured by Simco) after rubbing a polyester cloth of each sample with a wool cloth.

Surfaces of Sample A and Sample B were evaluated by using an XPS (X-ray photoelectron spectroscopy analyzer). Microlab 300-A (manufactured by VG) was used as a measuring device, and Mg-K$\alpha$, 1 keV, 20 mA as an optical source, and incident angle was 60°.

Figure 5A:
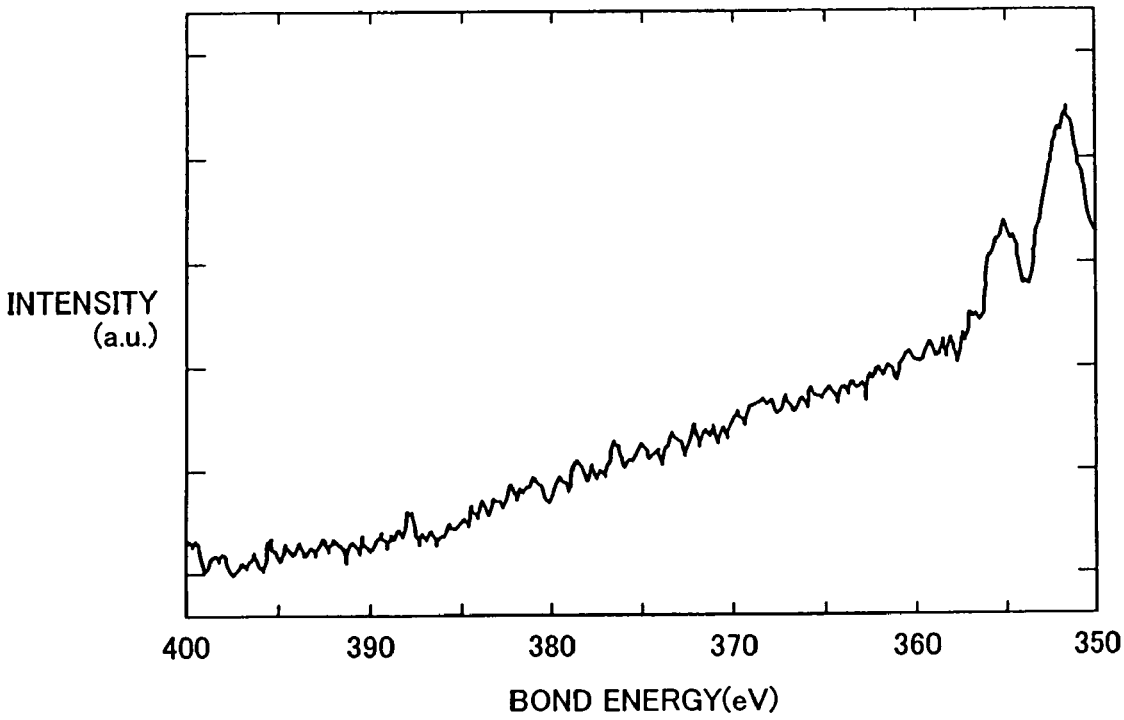
FIGS. 5A and 5B are views each showing a result of element analysis with respect to silver, showing an adhesion state of silver or a silver compound on the surface of polyester cloth evaluated by an XPS (X-ray photoelectron spectroscopy analyzer).
Figure 5B:
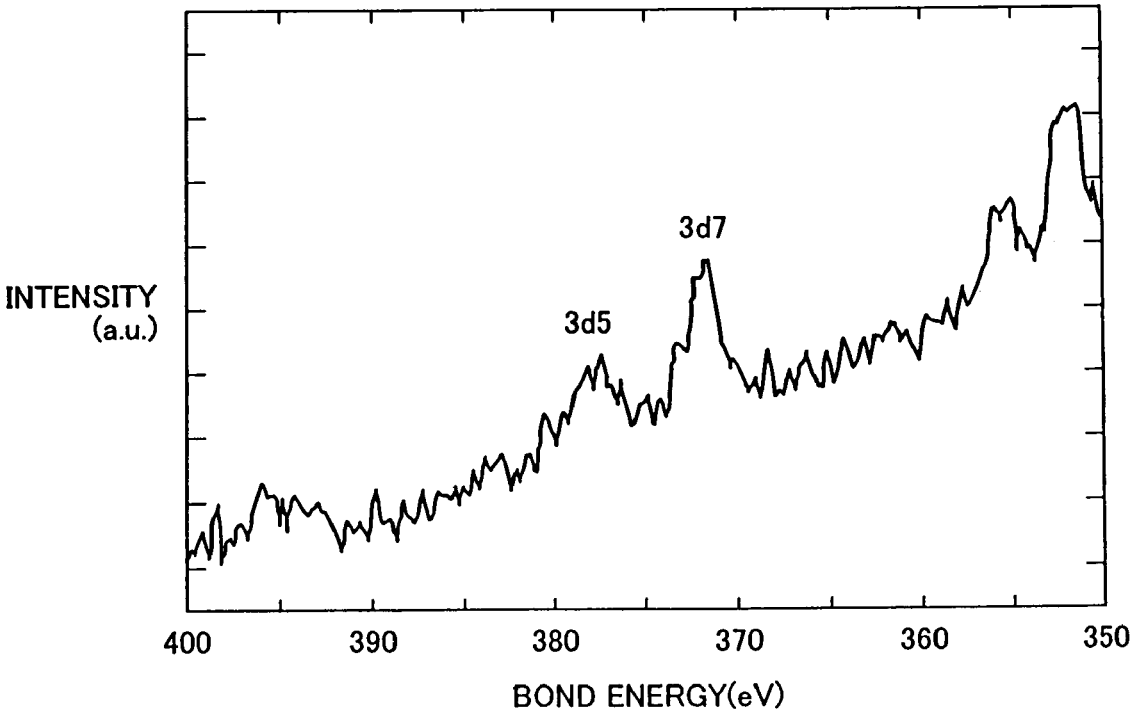

FIGS. 5A and 5B show a result of elemental analysis for silver, showing a result adhesion form of silver or a silver compound on the surface of polyester cloth evaluated by the XPS (X-ray photoelectron spectroscopy analyzer). FIG. 5A shows a result of XPS analysis for Sample A and FIG. 5B shows a result of XPS analysis for Sample B. As can be seen from FIGS. 5A and 5B, silver was not detected in Sample A and silver was detected in Sample B. According to literature data, it is reported that a peak shift occurs by −0.4 eV for $Ag_2O$ and −0.8 eV for AgO because a bond energy value of Ag is 368.2 eV and bond energy values of silver oxides are 367.8 eV for $Ag_2O$ and 367.4 eV for AgO. In FIG. 5B, the shift of the peak 3d7 representing a bond energy of Ag by about −0.4 eV reveals the existence of silver in oxidized state. In contrast, in FIG. 5A, a peak representing a bond energy of Ag was not observed. This demonstrates that silver was not detected on the surface in Sample A and silver or a silver compound was detected on the surface in Sample B. From correlation between these results and measurements of charge potential, it is possible to allow a great amount of silver or a silver compound to adhere on the surface of cloth and improve the antistatic performance more efficiently by making the silver or a silver compound adhere in a state where silver ion water exists on the surface of the cloth.

In the case of imparting antistaticity to clothes whose shapes may be lost or damaged through a washing step (delicate clothes or caps which are easy to loose their shapes), or in the case where greater antistaticity is desired to be imparted to the clothes, clothes may be directly put close to the water supply port of the washing machine through which water having a relatively high concentration of silver ion, for example silver ion water of 600 ppb, and caused to be wet on the surface of the clothes, thereby imparting antistaticity to the clothes. In this case, it is desired to dry directly after lightly dewatering the wet clothes.

It is to be considered that the embodiments and examples disclosed above are illustrated and not limitative in all respects. The scope of the present invention is defined by the appended claims rather than by the preceding description of embodiments and examples, and embraces all modifications and variations that fall within meets and bounds of the claims, or equivalence of such meets and bounds.

INDUSTRIAL APPLICABILITY

Using a method for imparting antistaticity to a fabric structure according to the present invention, it is possible to provide a fabric structure such as clothes that is able to reduce the uncomfortability to the wearer caused by static electricity by way of a routine operation such as washing operation.

The invention claimed is:

1. A method for imparting antistaticity to a fabric structure, comprising:

applying water containing silver ions of a first concentration on surfaces of clothes in a rinsing step after a washing step of the clothes;

spraying the water containing silver ions of a second concentration, larger than the first concentration, on the surface of the clothes using an atomizer mist; and drying the fabric structure in a state where the applied water containing silver ions is present and adheres on the surface of the fabric structure via surface tension.

2. The method for imparting antistaticity to a fabric structure according to claim 1, wherein applying the water containing silver ions on a surface of the fabric structure consists of spraying the water on the surface of the fabric structure, thereby allowing the silver ions to adhere on the surface of said fabric structure.

3. The method for imparting antistaticity to a fabric structure according to claim 1, wherein said water containing silver ions is a liquid in which metal ions elute out by electrolysis of metal electrodes in the liquid.

4. The method for imparting antistaticity to a fabric structure according to claim 1, wherein said silver ions are is made to adhere in an amount in a range between 0.5 mg or more and 50 mg or less, with respect to 1 kg of said fabric structure.

5. The method for imparting antistaticity to a fabric structure according to claim 1, wherein said fabric structure is a structure containing chemical fiber.

6. The method for imparting antistaticity to a fabric structure according to claim 1, wherein applying the water containing silver ions on a surface of the fabric structure consists of showering the water on the surface of the fabric structure, thereby allowing the silver ions to adhere on the surface of said fabric structure.

7. The method for imparting antistaticity to a fabric structure according to claim 6, wherein showering the water containing silver ions is carried out for 3 seconds.

8. The method for imparting antistaticity to a fabric structure according to claim 6, wherein showering the water containing silver ions is carried out for 20 seconds.

* * * * *